US011801580B1

(12) United States Patent
Allford et al.

(10) Patent No.: US 11,801,580 B1
(45) Date of Patent: Oct. 31, 2023

(54) DUAL AIRBAG COMPLIANCE DEVICE FOR BALL AND SEAT LAPPING

(71) Applicant: ARC SPECIALTIES, INC., Houston, TX (US)

(72) Inventors: Daniel Allford, Houston, TX (US); Nicholas Augustine, Houston, TX (US)

( * ) Notice: Subject to any disclaimer, the term of this patent is extended or adjusted under 35 U.S.C. 154(b) by 988 days.

(21) Appl. No.: 16/715,259

(22) Filed: Dec. 16, 2019

(51) Int. Cl.

| | |
|---|---|
| ***C23F 1/00*** | (2006.01) |
| ***B24B 15/08*** | (2006.01) |
| ***B24B 41/02*** | (2006.01) |
| ***B24B 37/005*** | (2012.01) |
| ***B24B 37/02*** | (2012.01) |
| ***B24B 37/27*** | (2012.01) |

(52) U.S. Cl.
CPC ..... *B24B 15/08* (2013.01); *B24B 37/005* (2013.01); *B24B 37/02* (2013.01); *B24B 37/27* (2013.01); *B24B 41/02* (2013.01)

(58) Field of Classification Search
CPC ..... F16K 27/067; F16K 5/0689; F16K 5/204; Y10T 137/0508; Y10T 137/6031; Y10T 137/6035
USPC ..... 156/345.15
See application file for complete search history.

(56) References Cited

U.S. PATENT DOCUMENTS 4,920,700 A 5/1990 Murahashi
5,097,635 A * 3/1992 Beasley ..... B24B 15/08 451/430
7,281,319 B1 10/2007 Allford
7,484,523 B2 * 2/2009 Church ..... F16K 27/067 137/454.6
7,681,865 B2 * 3/2010 Furnival ..... F16K 27/067 251/293
7,836,909 B2 * 11/2010 Church ..... F16K 5/204 251/315.08
10,183,364 B2 * 1/2019 Vincent ..... F16K 5/204
(Continued)

FOREIGN PATENT DOCUMENTS

CN 204019334 U 12/2014
CN 104551976 A 4/2015
(Continued)

OTHER PUBLICATIONS

Kemet product literature entitled "Precision Lapping and Polishing Systems", published 2015.
(Continued)

*Primary Examiner* — Long T Tran
*Assistant Examiner* — James J Kim
(74) *Attorney, Agent, or Firm* — Egbert, McDaniel & Swartz, PLLC

(57) ABSTRACT

An apparatus for rotating a seat relative to ball in a valve lapping machine includes a seat spindle assembly, an airbag assembly with a first and a second airbag, and a linear compensator affixed to a frame of the seat spindle assembly and to the seat tooling adapter plate. The airbag assembly is adapted to apply contact force between the seat and the ball. The linear compensator has a top plate, middle plate and a bottom plate. A first set of rails extends in a first direction so as to allow movement between the top plate and the middle plate, while a second set of rails which extends in a second direction perpendicular to the first direction allow movement of the bottom plate relative to the middle plate. A ball valve lapping machine utilizing this apparatus is also provided.

20 Claims, 3 Drawing Sheets

(56) References Cited

U.S. PATENT DOCUMENTS

| | | | | |
|---|---|---|---|---|
| 10,335,918 | B2 | 7/2019 | Yasuda | |
| 2005/0155225 | A1* | 7/2005 | Milberger | B24B 15/04 29/890.132 |
| 2011/0132255 | A1 | 6/2011 | Kinbara | |

FOREIGN PATENT DOCUMENTS

| | | | |
|---|---|---|---|
| EP | 0967048 | A1 | 12/1999 |
| KR | 101381868 | B1 | 4/2014 |
| KR | 101943044 | B1 | 1/2019 |

OTHER PUBLICATIONS

Lee, Hocheol et al.; "Airbag Tool Polishing for Aspherical Glass Lens Molds", Journal of Mechanical Science and Technology 24 (2010) 153-158; May 2, 2009.

* cited by examiner

DUAL AIRBAG COMPLIANCE DEVICE FOR BALL AND SEAT LAPPING

CROSS-REFERENCE TO RELATED APPLICATIONS

Not applicable.

STATEMENT REGARDING FEDERALLY SPONSORED RESEARCH OR DEVELOPMENT

Not applicable.

NAMES OF THE PARTIES TO A JOINT RESEARCH AGREEMENT

Not applicable.

INCORPORATION-BY-REFERENCE OF MATERIALS SUBMITTED ON A COMPACT DISC

Not applicable.

BACKGROUND OF THE INVENTION

1. Field of the Invention

The present invention relates to lapping devices. More particularly, the present invention relates to lapping devices for balls and seats used in severe and critical service ball valve applications.

2. Description of Related Art Including Information Disclosed Under 37 CFR 1.97 and 37 CFR 1.98

Ball valves are used in many applications and come in a variety of configurations. Generally speaking, a ball valve has a hollow ball with a passageway formed there through. The ball sits in a seats matched to the ball. When the ball is turned a quarter turn, the passageway through the ball lines up with a flow path of the seat, allowing flow through the valve. A stem may be connected to the ball and a lever connected to the stem so as to actuate the ball valve.

Lapping the seat-to-ball interface is required to create a seal in the assembled ball valve. Each set of seats and ball are lapped as a matching set for best fit. Varying degrees of tolerance are required depending upon the application.

Ball valves may be used in simple applications as well as a severe service and critical service applications. Severe and critical service applications require very close tolerances and precise lapping between the ball and seat surfaces. Critical service applications relate to the consequence of failure, such as use of a ball valve in a nuclear application, where failure of the ball valve would have great consequence. Severe service, on the other hand, relates to the environment in which the ball valve is used. Severe service applications are those in which the use/environment includes: extreme pressures, extreme pressure drops, extreme temperatures, either hot or cold, possible erosion and corrosive environments, and of environments wherein vibration may be an issue. Severe service ball valves are used in various industries.

Lapping the seat without deforming the ball due to the cutouts in the ball is a challenge. The goal of any lap procedure is to reduce the chance of failure, and reduce maintenance and repair incidences, which may be extremely time-consuming and expensive in severe service applications.

Some challenges for lapping are due to the fact that the ball and the seat are irregular surfaces. Irregularities and irregular surfaces cause floating or bouncing of the ball relative to the seat, reducing the tolerances in which such lapping machines are able to achieve.

Various patents have issued in the past relating to lapping technologies. For example, Publication No. CN204019334U (the '334 publication), which published on Dec. 17, 2014, describes a device for lapping of the ball and valve seat of the ball valve. Referring to the figures of the '334 publication, it can be seen that the valve seat is made to carry out reciprocating oscillating motion around the center of the ball through a crank and rocker mechanism. Rotational movement of the ball and rotation movement of the valve seat are combined in the device. Importantly, the '334 publication and includes three kinds of movement so as to achieve a relatively high precision during match lapping of the ball and seat.

Another publication, CN 104551976A (the '976 publication), describes another ball valve processing machine. Referring to the figures of the '976 publication, the ball valve core is driven by a valve rod chuck to rotate a rotating speed according to necessary requirements. It can be seen that the seat is rotated via separate motor from the ball valve.

U.S. Patent Publication No. 2005/0155225 (the '225 publication), published on Jul. 21, 2005, and describes another type of match lapping assembly. A method is provided in the '225 publication for match lapping a ball valve assembly. The method includes the following steps: contacting the seat with the ball; rotating the ball about a first rotational axis; rotating the seat about a second rotational axis; and changing an angle formed at the intersection of the first and second rotational axes. A lapping compound may be applied to one or both the ball and the seat, as is common in the industry.

Lapping technologies may also be utilized in other industries such as those for producing a silicon wafers. For example, U.S. Publication No. 2011/0132255 (the '255 publication), published on Jun. 9, 2011. The lapping device of the '255 publication utilizes airbags so as to apply force on both sides of the silicon wafer.

Lapping may also be utilized in processes for refinishing optical lenses, as is disclosed in U.S. Pat. No. 4,920,700. In this patent, the lapping system utilizes pressure adjustment by pneumatic means, wherein a substrate holder rotates while the lapping device swings and rotates relative to the optical lens to be finished.

Korean Publication No. 101943044 (the '044 publication) discloses a polishing machine for use in implant grinding. The polishing machine of the '044 publication as a part support for the implant which may rotate in multiple axes.

U.S. Pat. No. 10,335,918 discusses the use of a lapping machine for silicon wafer technologies and utilizes an airbag to apply force in a two-sided lapping context.

Publication No. EP 0967048 published on Dec. 29, 1991, discloses a two-sided flattening apparatus which may be used for lapping. The two airbags of the are provided on one side of the flattening apparatus.

Publication No. KR 101381868 also discloses a ball valve lapping machine, and is representative of the state-of-the-art.

As noted above, one of the challenges of achieving a close tolerance in a ball valve lapping context is the fact that due to irregular surfaces, it is difficult to maintain a constant pressure on the workpiece. U.S. Pat. No. 7,281,319 (the '319 patent), issued on Oct. 16, 2007 to one of the present inventors, Daniel Allford. The '319 patent discloses an apparatus for manufacturing a wire wound filter screen by wrapping wrap wire over a set of rib wires. The apparatus has a frame, a spindle for supporting the rib wires in a longitudinal orientation, a wire guide for delivering wrap wire around the rib wires as the spindle rotates the rib wires, an electrode for welding the wrap wires to the rib wires at each intersection thereof, and a translating mechanism positioned on the frame for moving rib wires and the welded wrap wire longitudinal along the frame. A laser measures a gap between adjacent surfaces of wrap wire. A processor is used to adjust the translating of the rib wires relative to the gap. An air cushion urges the electrode against the wrap wire. Importantly, the apparatus of the '319 patent utilizes a dual airbag system so as to provide a constant force or pressure so as to urge the electrode against the wrap wire.

It is an object of the present invention to provide a lapping device for severe and critical service ball valves.

It is object of the present invention to provide a lapping device which can lap the ball and seat without deforming due to the cutouts in the ball.

It is another object of the present invention to provide a lapping device which applies a constant pressure on the ball and seats, or any other irregularly-shaped workpiece utilized without jumping.

It is another object of the present invention to provide a lapping device which allows for an automatic following of the contour of the part being worked.

It is another object of the present invention to provide a lapping device which utilizes air springs so as to maintains constant pressure.

It is another object the present invention to provide a lapping device which allows the tool force to be easily and quickly varied from zero to the maximum tool force applied.

It is another object of the present invention provide a lapping to device which restricts the seat to float only horizontally.

These and other objects and advantages of the present invention will become apparent from a reading of the attached specification and appended claims.

BRIEF SUMMARY OF THE INVENTION

An embodiment of present invention is an apparatus for lapping a ball and seats of a ball valve. The apparatus includes a body with first carriage assembly positioned on the body. The first carriage assembly has a seat spindle assembly with a frame, a seat spindle motor, and a seat tooling adapter plate. The seat spindle assembly is adapted to hold and rotate one of the seats. The first carriage assembly also has a linear compensator affixed to the frame of the seat spindle assembly and to the seat tooling adapter plate. The seat tooling adapter plate is restricted to float in a single plane by the linear compensator. A second carriage assembly is positioned on the body. Each of the first and second carriage assemblies are adjustable relative to the body. A ball frame is positioned on the body between the first carriage assembly and the second carriage assembly. The ball frame is adapted to hold and rotate the ball.

In an embodiment, the first carriage assembly is an upper carriage assembly, and the second carriage assembly is a lower carriage assembly.

In an embodiment, the linear compensator includes a top plate, a middle plate, and a bottom plate rigidly connected to the seat tooling adapter plate. A first set of rails is positioned between the top plate and the middle plate. The first set of rails allow for movement of the middle plate relative to the top plate in a first direction in the single plane. A second set of rails is positioned between the middle plate and the bottom plate. The second set of rails allow for movement of bottom plate relative to the middle plate in a second direction in the single plane. The second direction is preferably perpendicular to the first direction.

In an embodiment, the first carriage assembly includes an airbag assembly having a first airbag and a second airbag. The airbag assembly is connected to a plate of the first carriage assembly and to the frame of the seat spindle assembly. The airbag assembly is adapted to adjust a position of the seat spindle assembly relative to the plate of the first carriage assembly. In an embodiment, a load cell may be provided in communication with the airbag assembly, the load cell being adapted to measure a contact force between the seat loaded on the seat spindle assembly, and the ball loaded on the ball frame. A carriage drive gearmotor may be operatively connected to the first carriage assembly. Controls may be provided in communication with the load cell and with the carriage drive gearmotor.

In an embodiment, an upper proximity switch and a lower proximity switch are affixed to the frame of the spindle assembly. A centering dog is preferably positioned on the plate of the first carriage assembly.

In an embodiment, the ball frame includes a frame; a ball head stock assembly having a ball motor thereon, the ball head stock assembly affixed to the frame; a fixture operatively connected to the ball motor and adapted to be received by a bore of the ball loaded on the ball frame, the fixture and the ball motor operating to rotate the ball about a first axis; and a ball tail stock assembly. The ball tail stock assembly is affixed to the frame. In an embodiment, the ball frame is rotatable about a second axis perpendicular to the first axis.

In an embodiment, a ball tilt motor is positioned in the body and is operatively connected to the ball frame.

Another embodiment of the present invention is an apparatus for lapping a ball and seats of a ball valve. The apparatus has a body and a first carriage assembly positioned on the body. The first carriage assembly includes a plate, a seat spindle assembly, and an airbag assembly. The seat spindle assembly has a frame, a seat spindle motor, and a seat tooling adapter plate. The seat spindle assembly is adapted to hold and rotate one of the seats. The airbag assembly has a first airbag and a second airbag, and is connected to the plate and to the frame of the seat spindle assembly. The airbag assembly is adapted to adjust a position of the seat spindle assembly relative to the plate of the first carriage assembly. The apparatus has a second carriage assembly positioned on the body. Each of the first and second carriage assemblies are adjustable relative to the body. The apparatus also has a ball frame positioned on the body between the first and second carriage assemblies. The ball frame is adapted to hold and rotate the ball.

In an embodiment, the first carriage assembly is an upper carriage assembly, and the second carriage assembly being a lower carriage assembly. In an embodiment, the second carriage assembly includes a plate, a seat spindle assembly, and an airbag assembly. The seat spindle assembly has a frame, a seat spindle motor, and a seat tooling adapter plate. The seat spindle assembly is adapted to hold and rotate another one of the seats. The airbag assembly has a first airbag and a second airbag, and is connected to the plate and to the frame of said the spindle assembly. This airbag assembly is adapted to adjust a position of the seat spindle assembly relative to the plate of the second carriage assembly.

In an embodiment, the apparatus includes a linear compensator affixed to the frame and to the seat tooling adapter plate. The seat tooling adapter plate is restricted to float in a single plane by the linear compensator.

In an embodiment, the linear compensator has a top plate, a middle plate, a bottom plate rigidly connected to the seat tooling adapter plate, and a first set of rails positioned between the top plate and the middle plate. The first set of rails allow for movement of the middle plate relative to the top plate in a first direction in the single plane. The linear compensator also has a second set of rails positioned between the middle plate and the bottom plate. The second set of rails allow for movement of the bottom plate relative to the middle plate in a second direction in the single plane. The second direction is preferably perpendicular to the first direction.

In an embodiment, the apparatus also has a load cell in communication with the (first and/or second) airbag assembly, the load cell adapted to measure a contact force between the seat loaded on the seat spindle assembly, and the ball loaded on the ball frame. In an embodiment, a carriage drive gearmotor is operatively connected to the first carriage assembly, and controls are provided in communication with the load cell and with the carriage drive gearmotor.

In an embodiment, an upper proximity switch is affixed to the frame of the seat spindle assembly. A lower proximity switch is affixed to the frame of the seat spindle assembly. A centering dog is preferably positioned on the plate of the first carriage assembly.

In an embodiment, the ball frame has a frame, and a ball head stock assembly affixed to the frame, the having a ball motor thereon. A fixture is operatively connected to the ball motor and adapted to be received by a bore of the ball loaded on the ball frame. The fixture and the ball motor operate to rotate the ball about a first axis. A ball tail stock assembly is also affixed to the frame of the ball frame. In an embodiment, the ball frame is rotatable about a second axis perpendicular to the first axis.

In an embodiment, the present invention is an apparatus for rotating a seat relative to a ball in a ball valve lapping machine. The apparatus includes a seat spindle assembly having a frame, a seat spindle motor, and a seat tooling adapter plate. The seat spindle assembly is adapted to hold and rotate the seat. An airbag assembly is provided having a first airbag and a second airbag. The airbag assembly is connected to the frame of the seat spindle assembly. The airbag assembly is adapted to apply a set contact force between the seat and the ball. A linear compensator is affixed to the frame and to the seat tooling adapter plate. The seat tooling adapter plate is restricted to float in a single plane by the linear compensator. The linear compensator preferably includes a top plate, a middle plate, and a bottom plate rigidly connected to the seat tooling adapter plate. The linear compensator also has a first set of rails positioned between the top plate and the middle plate. The first set of rails allow for movement of the middle plate relative to the top plate in a first direction in the single plane. A second set of rails are positioned between the middle plate and the bottom plate. The second set of rails allow for movement of the bottom plate relative to the middle plate in a second direction in the single plane. The second direction is perpendicular to the first direction.

This foregoing Section is intended to describe, with particularity, the preferred embodiments of the present invention. It is understood that modifications to these preferred embodiments can be made within the scope of the present claims. As such, this Section should not to be construed, in any way, as limiting of the broad scope of the present invention. The present invention should only be limited by the following claims and their legal equivalents.

DETAILED DESCRIPTION OF THE INVENTION

Figure 1:
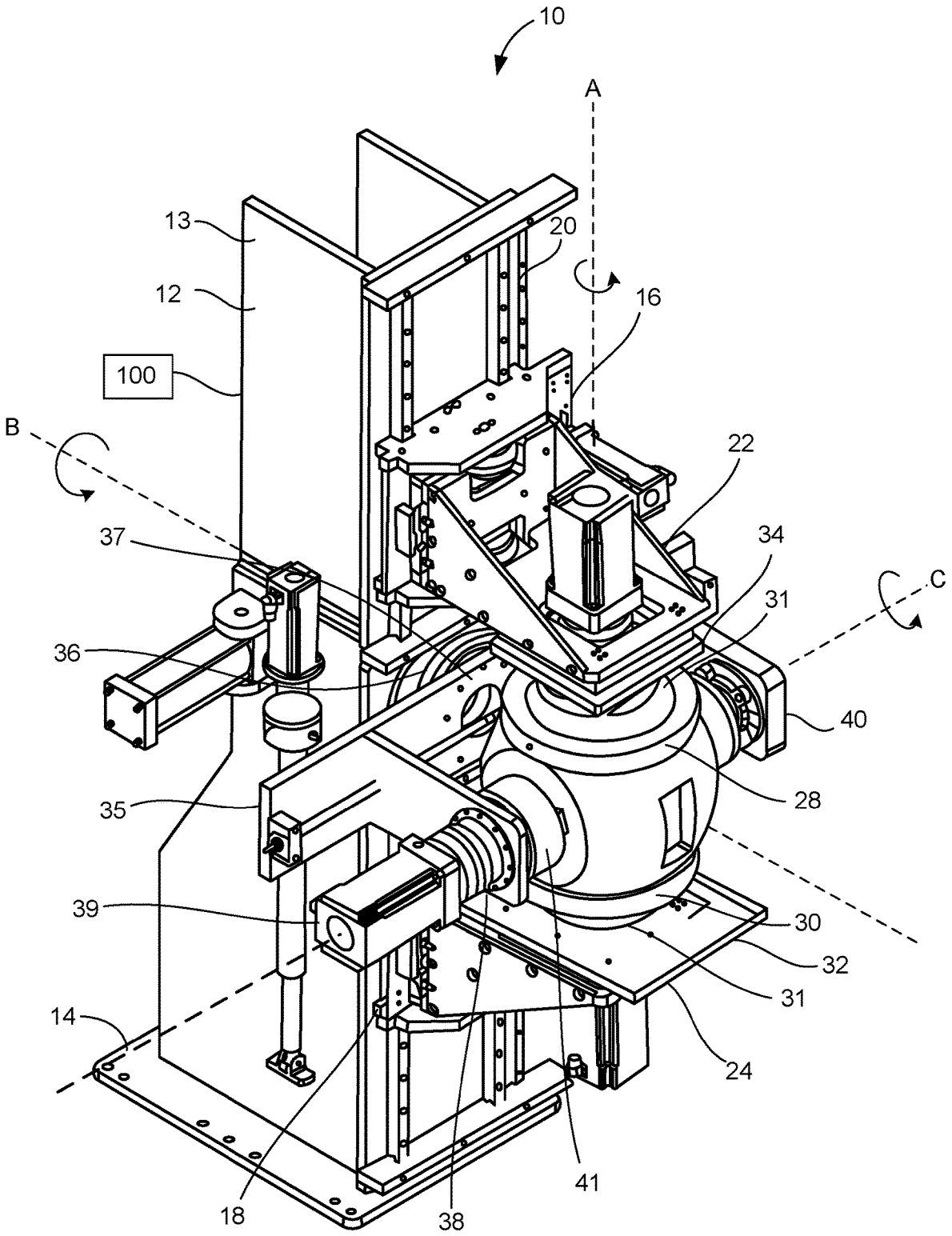
FIG. 1 illustrates a perspective view of the ball and seat lapping machine of the preferred embodiment of the present invention.

Referring to FIG. 1, there is shown a perspective view of the ball and seat lapping machine 10 of the preferred embodiment of the present invention. The machine 10 includes a body 12 having a generally vertical component 13. A base 14 is shown at the bottom of the vertical component 13.

Mounted to the body 12 are an upper carriage assembly 16 and a lower carriage assembly 18. Generally, the lower carriage assembly 18 is a mirror image of the upper carriage assembly 16, with some minor deviations in certain embodiments. The upper carriage assembly 16 and lower carriage assembly 18 are vertically adjustable on the vertical component 13 of the body 12, and are mounted on a pair of carriage linear rails 20, which are shown as extending along the vertical component 13 of the body 12.

The upper carriage assembly 16 includes an upper seat spindle assembly 22. Similarly, the lower carriage assembly 18 includes a lower seat spindle assembly 24. A ball 26 is shown as positioned between the carriage assemblies 16 and 18. More specifically, the ball 26 is shown as being positioned between the seats 28 and 30. Seat 28 is operatively connected to the upper seat spindle assembly 22 of the upper carriage assembly 16. Similarly, the seat 30 is operatively connected to the lower seat spindle assembly 24 of the lower carriage assembly 18.

As will be explained hereinunder, the seat spindle assemblies 22 and 24 serve to rotate the seats 28 and 30, respectively, relative to the ball 26 and about an axis A.

FIG. 1 illustrates how the upper seat spindle assembly 22 has a seat tooling adapter plate 31, which is connected to the seat 28. Similarly, the lower seat spindle assembly 24 has a seat tooling adapter plate 31, with a seat tooling table 32 therebelow. The seat 30 is connected to the seat tooling adapter plate 31 of the lower seat spindle assembly 24.

Also shown in FIG. 1 is a linear compensator 34. As will be explained, the linear compensator 34 restricts float of the seat in the horizontal direction, thus disallowing any orbital rotation about the ball so that the seat 30 cannot twist into the void of the ball 26. An inverted version of this linear compensator is preferably provided on the lower carriage assembly 18 in embodiments of the present invention.

FIG. 1 also illustrates the ball frame 35 of the present invention. In a preferred embodiment, the ball frame 35 is a ball tilt frame. In embodiments where in the ball frame 35 tilts, the ball frame 35 has a ball tilt motor 36, a portion of which is shown in FIG. 1. The ball tilt motor 36 serves to tilt the ball frame 35 about an axis B extending through the center 37 of the ball frame 35.

The ball frame 35 is connected to a ball head stock assembly 38. The ball head stock assembly 38 contains a ball motor 39. Opposite the ball head stock assembly 38 is the ball tail stock assembly 40. A fixture 41 is operatively connected to the ball motor 39, and is adapted to be received within the bore of the ball 26 so as to rotate or spin the ball about an axis C. Different fixtures may be used depending on the size of the ball valve on which the machine 10 is operating on.

In embodiments wherein the ball frame 35 tilts the ball, the ball frame 35 serves to both spin the ball about the axis C, and tilts the ball about the axis B perpendicular thereto. This arrangement allows for uniform lapping of the seat to ball interface thus creating a better seal in the assembled ball valve.

Controls 100 are shown as being operatively connected to the various components of the ball and seat lapping machine 10, and serve to control the various components of the ball and seat lapping seat machine 10.

Figure 2:
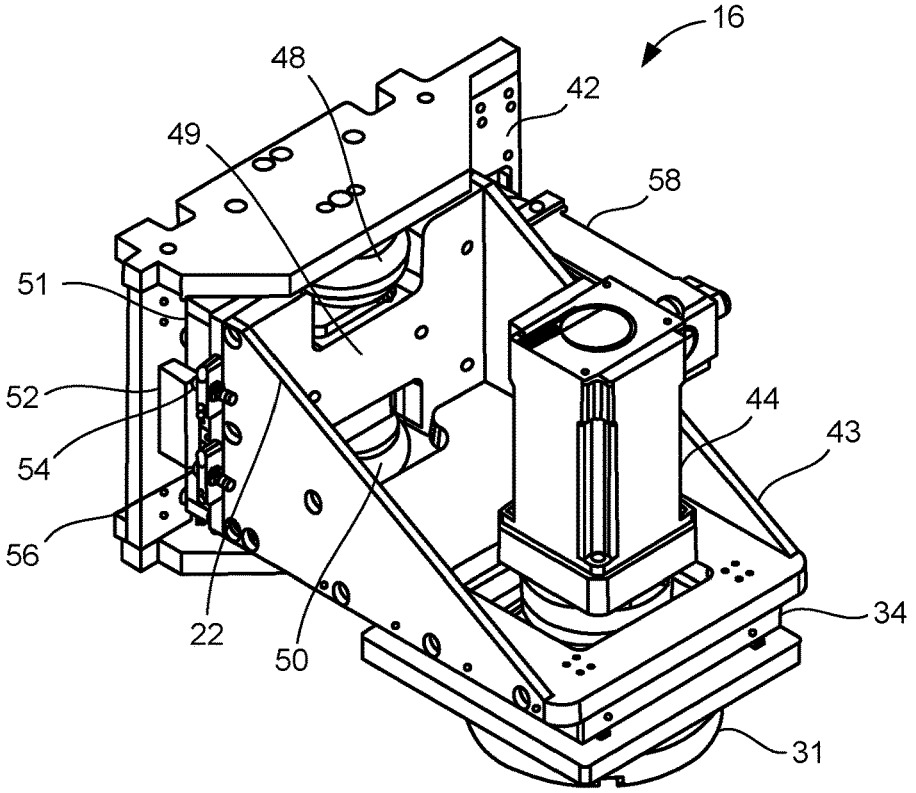
FIG. 2 is an isolated view illustrating the upper carriage assembly of the preferred embodiment of the present invention.

Referring to FIG. 2, there is shown an isolated view of the upper carriage assembly 16. FIG. 2 illustrates how the upper carriage assembly 16 preferably has a carriage backplate 42. A frame 43 of the seat spindle assembly 22 extends in an outward direction from the carriage backplate 42.

A seat spindle motor 44 extends upwardly from the seat tooling adapter plate 31. The seat tooling adapter plate 31 is connected to the ball. The seat spindle motor 44 is operatively connected to the seat tooling adapter plate 31 so as to spin seat tooling adapter plate 31 and the seat connected thereto.

Also connected to the seat spindle motor 44 and to the seat tooling adapter plate 31 is the linear compensator 34. This linear compensator 34 will be described in more detail with reference to FIG. 4.

Importantly, FIG. 2 illustrates the airbag assembly 49, which comprises an upper airbag 48 and a lower airbag 50. The airbag assembly 49 is mounted on the carriage backplate 42 along airbag linear guide rails 51. Thus, the airbags 48 and 50 allow for movement of the upper seat spindle assembly 22 relative to the carriage backplate 42.

As will be explained herein below, centering of the airbags 48 and 50 relative to the upper carriage assembly 16 is accomplished through the use of the centering dog 52, which is mounted to the carriage backplate 42. The upper seat spindle assembly 22 has an upper centering proximity switch 54 and a lower centering proximity switch 56 which allow for monitoring or detecting a position of the respective switches relative to the centering dog 52.

A carriage drive gear motor 58 is provided so as to adjust to the position of the upper carriage assembly so as to maintain a seat pressure on the ball.

The lower carriage assembly preferably has identical, inverted components as the upper carriage assembly 16. As such, FIG. 2 should be considered an inverted perspective view of the lower carriage assembly 18.

Figure 3:
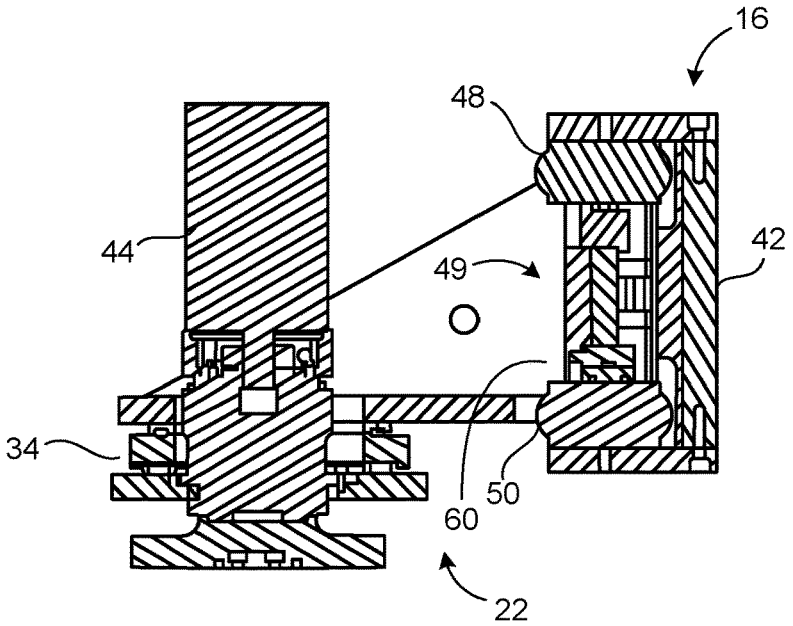
FIG. 3 is a cross-sectional view illustrating the relationship between the airbag assembly and the upper carriage assembly of the ball and seat lapping machine of the preferred embodiment of the present invention.

FIG. 3 provides a partial cross-sectional view of the upper carriage assembly 16. In FIG. 3 illustrates a load cell 60 positioned between the upper airbag 48 and the lower airbag 50. The load cell 16 is used to sense a contact force between the seat and the ball. FIG. 3 also illustrates how the airbags 48 and 50 serve to position the upper seat spindle assembly 22.

Figure 4:
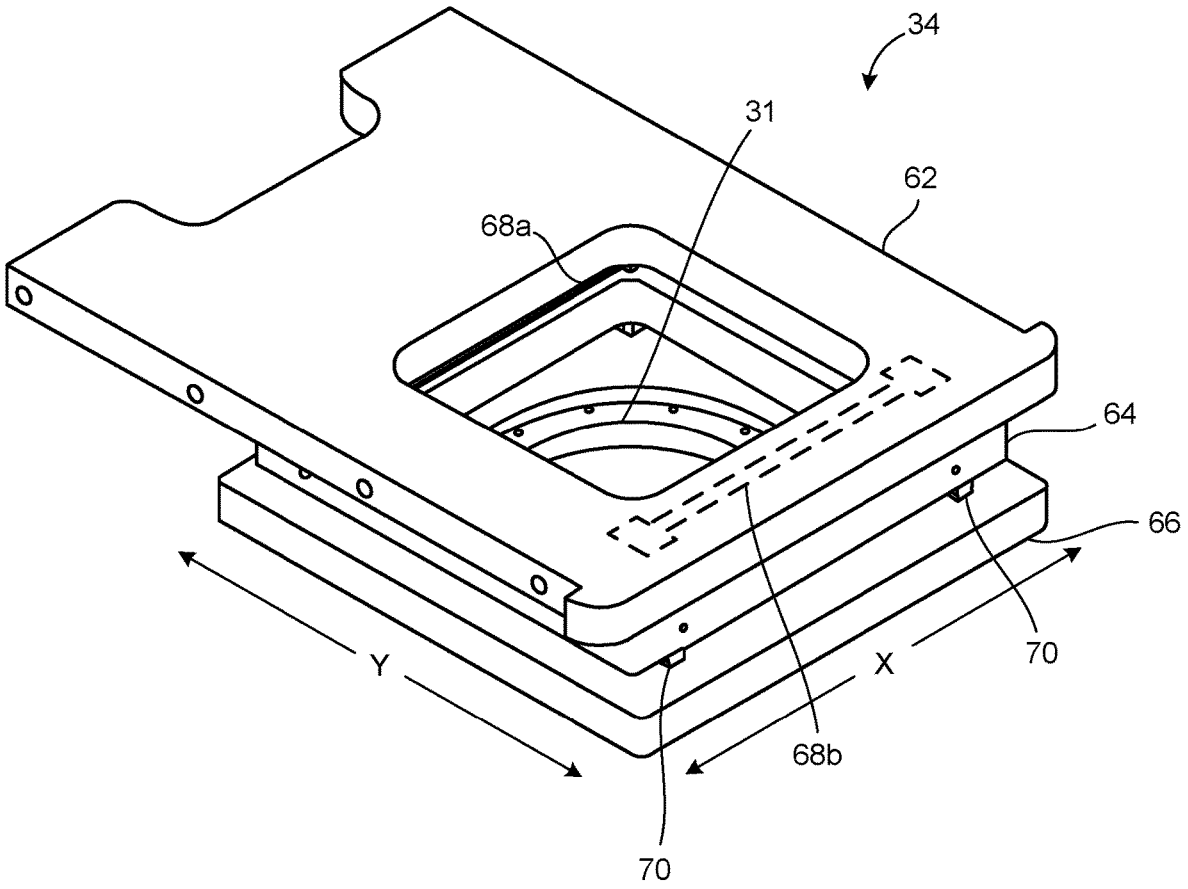
FIG. 4 is an isolated view illustrating the linear compensator the subject of the present invention.

Referring to FIG. 4, there is shown an isolated view of the linear compensator 34. FIG. 4 shows the linear compensator 34 as having a top plate 62, which is attached to the upper carriage assembly 16. Also shown are the middle plate 64 and the bottom plate 66.

A first set of horizontal rails 68*a* and 68*b* are positioned between the top plate 62 and the middle plate 64. Rails 68*b* are shown in broken lines for ease of illustration. This first set of horizontal rails 68*a* and 68*b* allow for the middle plate 64 to a float in a direction along on the X axis relative to the top plate 62. This also allows the bottom plate 66 (as it is connected to the middle plate 64) and the seat connected to the bottom plate 66 to move along the X axis relative to the top plate 62 as well. Preferably the allowable float is approximately 1".

Similarly, a second set of rails 70*a* and 70*b* is provided between the bottom plate 66 and the middle plate 64. This second set of rails 70*a* and 70*b* allow for the assembly to float in the Y-axis. While only the ends of the rails 70*a* and 70*b* are visible in FIG. 4, these rails extend along the Y-axis in the direction of the carriage back plate. Preferably the allowable float is approximately 1". Importantly, the linear compensator 34 restricts flotation to these directions within a single plane in the horizontal axis, (assuming the machine is oriented vertically). The gear motor mounting flange 31 is also visible in FIG. 4.

The seat spindle is mounted to the bottom plate 66. This allows the seat to float in two axes on the ball frame, namely the X and Y axes shown in FIG. 4. As the ball rotates, wobbles because of imperfect machining and mounting of the ball and seat in the fixtures. The seat follows this wobble left, right, in and out with the linear compensator 34. The airbags 40 and 50 handle the vertical the Z movement, which keeps the seat in contact with the ball while lapping, but do not let the seat dip or twist into the ball causing gouges or low spots in the lapping process.

Preferably, the operation of the machine is as follows:

1. The Ball 26 and the upper seat 28 or lower seat 30 or both seats are loaded into the machine 10.

2. Through the controls 100, the operator loads a predetermined recipe. The recipe includes:

a. ball speed;
b. upper seat speed;
c. upper seat pressure;
d. lower seat speed;
e. lower seat pressure;
f. ball tilt angle;
g. ball tilt speed; and
h. operation time.

3. Once the cycle start is initiated, the control lowers the upper carriage assembly 16 (if used) and raises the lower carriage assembly 18 (if used).

4. The lower airbag 50 is pressurized until the spindle carriage 22 raises up. Once the lower centering proximity switch 56 is on the centering dog 52 and the upper centering proximity switch 56 is on the centering dog 52, the upper airbag 48 is pressurized (if needed) until both proximity switches 56 and 58 are on the centering dog 52. This centers the airbag assembly 49.

5. When the upper seat spindle assembly 22 is centered, it is then lowered until the seat 28 comes in contact with the ball 26. The contact force is measured with the load cell 60 until the load matches the programed force in the recipe.

6. Steps 4 and 5 are inverted as required and repeated for the lower carriage assembly 18 if used in the recipe.

7. The control 100 then spins the seats 28 and 30, and the ball 26 up to the recipe settings and begins tilting the ball back and forth using the ball tilt frame 35.

8. The control 100 monitors the load cells 60 on both the upper and lower carriages assemblies 16 and 18, adjusting the positions using the carriage drive gear motors 58 to maintain seat pressure.

Small rapid vertical deflections occurring during the lapping process are absorbed by the airbag system to maintain seat pressure and contact with the ball 26.

Horizontal misalignments for the top seat are absorbed by the linear compensator 34 mounted between the upper seat spindle assembly 22 and the upper carriage assembly 16.

Horizontal misalignments for the bottom seat are absorbed by the linear compensator (not visible) mounted between the lower seat spindle assembly 24 and lower carriage assembly 18.

As discussed above, lapping the seat without deforming the ball due to cut outs the ball is a challenge in the field. The ball and seat lapping machine 10 of the present invention overcomes these challenges in two ways. First the seats are restricted to float only horizontally, and not orbitally about the ball 26, so that seat cannot twist into the voids of the ball. This first solution is enabled by the novel linear compensator. Second, the seat is restricted to float vertically to allow for run out in the ball lapping process. This is accomplished using the airbag system, which provides a constant force between the seat and the ball, preventing jumping of the ball relative to the seat. These two degrees of freedom create a free-floating seat spindle arrangement, which keeps the seat square to the ball but allows compliance while lapping the seat to ball interface.

The machine of the present invention can be used with the conventional lapping compounds, such as diamond paste, to achieve optimum results.

The machine of the present invention can be for used in simpler applications, but also in severe and critical service applications wherein the consequences of failure or the conditions in which the ball valve operate require very close tolerances. Ball valves lapped using the machine of the present invention would have reduced chance of failure, and reduced maintenance and repair costs with compared with ball valves which are lapped using more conventional processes.

By use of the airbag system of the present invention, the machine of the present invention can be utilized with different sizes of balls and seats, which require different amounts of pressure between the respective balls and seats. This reduces the time and expense associated with hardware and the changing out of hardware components and conventional machines for switching sizes balls and seats.

The airbags of the present invention operate as air springs and are able to maintain a constant force by using a computer control closed-loop pressurization system. The airbags 48 and 50 oppose each other so the force can be varied from zero to the maximum capacity of the system easily and quickly. One advantage of utilizing upper and lower airbags, or air springs, is that as the orientation of the tool changes relative to the vertical, the weight of the tool force can be compensated for independent of orientation (as gravity adds tool force when the tool points down, and subtracts tool force when the tools pointed up). A concept of the airbags were as air springs for a applying pressure with the tool can be used in other applications including polishing grinding and sanding applications.

The foregoing disclosure and description of the invention is illustrative and explanatory thereof. Various changes in the details of the illustrated construction can be made within the scope of the appended claims without departing from the true spirit of the invention. The present invention should only be limited by the following claims and their legal equivalents.

We claim:

1. An apparatus for lapping a ball and seats of a ball valve, the apparatus comprising:

a body;

a first carriage assembly positioned on said body, said first carriage assembly comprising:

a seat spindle assembly having a frame, a seat spindle motor, and a seat tooling adapter plate, said seat spindle assembly adapted to hold and rotate one of the seats; and a linear compensator affixed to said frame of said seat spindle assembly and to said seat tooling adapter plate, said seat tooling adapter plate being restricted to float in a single plane by said linear compensator;

a second carriage assembly positioned on said body, each of said first carriage assembly and said second carriage assembly being adjustable relative to said body; and a ball frame positioned on said body between said first carriage assembly and said second carriage assembly, said ball frame adapted to hold and rotate the ball.

2. The apparatus of claim 1, said first carriage assembly being an upper carriage assembly, and said second carriage assembly being a lower carriage assembly.

3. The apparatus of claim 1, said linear compensator comprising:

a top plate;

a middle plate;

a first set of rails positioned between said top plate and said middle plate, said first set of rails allowing for movement of said middle plate relative to said top plate in a first direction in said single plane;

a bottom plate rigidly connected to said seat tooling adapter plate; and a second set of rails positioned between said middle plate and said bottom plate, said second set of rails allowing for movement of said bottom plate relative to said middle plate in a second direction in said single plane, said second direction being perpendicular to said first direction.

4. The apparatus of claim 1, said first carriage assembly comprising:

an airbag assembly comprising a first airbag and a second airbag, said airbag assembly connected to a plate of said first carriage assembly and to said frame of said seat spindle assembly, said airbag assembly adapted to adjust a position of said seat spindle assembly relative to said plate of said first carriage assembly.

5. The apparatus of claim 4, further comprising:

a load cell in communication with said airbag assembly, said load cell adapted to measure a contact force between the seat loaded on the seat spindle assembly, and the ball loaded on the ball frame.

6. The apparatus of claim 5, further comprising:

a carriage drive gearmotor operatively connected to said first carriage assembly; and controls in communication with said load cell and with said carriage drive gearmotor.

7. The apparatus of claim 4, further comprising:

an upper proximity switch affixed to said frame of said seat spindle assembly;

a lower proximity switch affixed to said frame of said seat spindle assembly; and a centering dog positioned on said plate of said first carriage assembly.

8. The apparatus of claim 1, said ball frame comprising:

a frame;

a ball head stock assembly having a ball motor thereon, said ball head stock assembly affixed to said frame;

a fixture operatively connected to said ball motor and adapted to be received by a bore of the ball loaded on said ball frame, said fixture and said ball motor operating to rotate the ball about a first axis; and a ball tail stock assembly, said ball tail stock assembly affixed to said frame.

9. The apparatus of claim 8, said ball frame being rotatable about a second axis, said second axis being perpendicular to said first axis.

10. The apparatus of claim 9, further comprising:

a ball tilt motor positioned in said body, said ball tilt motor operatively connected to said ball frame.

11. An apparatus for lapping a ball and seats of a ball valve, the apparatus comprising:

a body;

a first carriage assembly positioned on said body, said first carriage assembly comprising:

a plate;

a seat spindle assembly having a frame, a seat spindle motor, and a seat tooling adapter plate, said seat spindle assembly adapted to hold and rotate one of the seats; and an airbag assembly comprising a first airbag and a second airbag, said airbag assembly connected to said plate and to said frame of said seat spindle assembly, said airbag assembly adapted to adjust a position of said seat spindle assembly relative to said plate of said first carriage assembly;

a second carriage assembly positioned on said body, each of said first carriage assembly and said second carriage assembly being adjustable relative to said body; and a ball frame positioned on said body between said first carriage assembly and said second carriage assembly, said ball frame adapted to hold and rotate the ball.

12. The apparatus of claim 11, said first carriage assembly being an upper carriage assembly, and said second carriage assembly being a lower carriage assembly, said second carriage assembly comprising:

a plate;

a seat spindle assembly having a frame, a seat spindle motor, and a seat tooling adapter plate, said seat spindle assembly adapted to hold and rotate another one of the seats; and an airbag assembly comprising a first airbag and a second airbag, said airbag assembly connected to said plate and to said frame of said seat spindle assembly, said airbag assembly adapted to adjust a position of said seat spindle assembly relative to said plate of said second carriage assembly.

13. The apparatus of claim 11, further comprising a linear compensator affixed to said frame and to said seat tooling adapter plate, said seat tooling adapter plate being restricted to float in a single plane by said linear compensator.

14. The apparatus of claim 13, said linear compensator comprising:

a top plate;

a middle plate;

a first set of rails positioned between said top plate and said middle plate, said first set of rails allowing for movement of said middle plate relative to said top plate in a first direction in said single plane;

a bottom plate rigidly connected to said seat tooling adapter plate; and a second set of rails positioned between said middle plate and said bottom plate, said second set of rails allowing for movement of said bottom plate relative to said middle plate in a second direction in said single plane, said second direction being perpendicular to said first direction.

15. The apparatus of claim 11, further comprising:

a load cell in communication with said airbag assembly, said load cell adapted to measure a contact force between the seat loaded on the seat spindle assembly, and the ball loaded on the ball frame.

16. The apparatus of claim 15, further comprising:

a carriage drive gearmotor operatively connected to said first carriage assembly; and controls in communication with said load cell and with said carriage drive gearmotor.

17. The apparatus of claim 11, further comprising:

an upper proximity switch affixed to said frame of said seat spindle assembly;

a lower proximity switch affixed to said frame of said seat spindle assembly; and a centering dog positioned on said plate of said first carriage assembly.

18. The apparatus of claim 11, said ball frame comprising:

a frame;

a ball head stock assembly having a ball motor thereon, said ball head stock assembly affixed to said frame;

a fixture operatively connected to said ball motor and adapted to be received by a bore of the ball loaded on said ball frame, said fixture and said ball motor operating to rotate the ball about a first axis; and a ball tail stock assembly, said ball tail stock assembly affixed to said frame.

19. The apparatus of claim 18, said ball frame being rotatable about a second axis, said second axis being perpendicular to said first axis.

20. An apparatus for rotating a seat relative to a ball in a ball valve lapping machine, the apparatus comprising:

a seat spindle assembly having a frame, a seat spindle motor, and a seat tooling adapter plate, said seat spindle assembly adapted to hold and rotate the seat;

an airbag assembly having a first airbag and a second airbag, said airbag assembly connected to said frame of said seat spindle assembly, said airbag assembly adapted to apply a set contact force between the seat and the ball; and a linear compensator affixed to said frame and to said seat tooling adapter plate, said seat tooling adapter plate being restricted to float in a single plane by said linear compensator, said linear compensator comprising:

a top plate;

a middle plate;

a first set of rails positioned between said top plate and said middle plate, said first set of rails allowing for movement of said middle plate relative to said top plate in a first direction in said single plane;

a bottom plate rigidly connected to said seat tooling adapter plate; and a second set of rails positioned between said middle plate and said bottom plate, said second set of rails allowing for movement of said bottom plate relative to said middle plate in a second direction in said single plane, said second direction being perpendicular to said first direction.

* * * * *